United States Patent [19]

Bandlish et al.

[11] Patent Number: 4,962,234

[45] Date of Patent: Oct. 9, 1990

[54] ANTIOXIDANT FOR POLYESTER FLUIDS - ALPHA - METHYL - N PHENYLBENZENEMETHANAMINE

[75] Inventors: Baldev K. Bandlish, Middlebury; Frederick C. Loveless, Cheshire; Walter Nudenberg, Newtown, all of Conn.

[73] Assignee: Uniroyal Chemical Company, Inc., Middlebury, Conn.

[21] Appl. No.: 201,270

[22] Filed: Jun. 1, 1988

Related U.S. Application Data

[63] Continuation of Ser. No. 701,884, Mar. 11, 1985, which is a continuation of Ser. No. 198,085, Oct. 17, 1980, abandoned, which is a continuation of Ser. No. 43,996, May 31, 1979, abandoned.

[51] Int. Cl.[5] ..... C07C 211/00

[52] U.S. Cl. ..... 564/384; 564/391; 564/392; 564/428; 564/429

[58] Field of Search ..... 564/384, 391, 392, 428, 564/429

[56] References Cited

U.S. PATENT DOCUMENTS

| | | | |
|---|---|---|---|
| 1,989,325 | 1/1933 | Lommel et al. | 564/392 X |
| 2,109,165 | 2/1938 | Cramer | 564/428 X |
| 2,131,206 | 9/1938 | Williams et al. | 564/384 X |
| 2,144,446 | 1/1939 | Williams et al. | 564/384 X |
| 2,276,587 | 3/1942 | Mettler et al. | 564/392 X |
| 2,451,642 | 10/1948 | Watson | 564/384 X |
| 2,462,237 | 2/1949 | Thompson et al. | 564/384 X |
| 2,566,289 | 8/1951 | Mastin | 564/384 X |
| 2,764,591 | 9/1956 | Sprinzak . | |
| 2,977,308 | 3/1961 | Muller et al. | 574/428 X |
| 3,177,234 | 4/1965 | d'Ostrowick et al. | 564/392 X |
| 3,177,266 | 4/1965 | d'Ostrowick et al. | 564/392 X |
| 3,759,597 | 9/1973 | Napolitano | 564/428 X |
| 3,849,322 | 11/1974 | Wendler et al. | 564/384 X |

OTHER PUBLICATIONS

Hayes et al., Jour. Chem. Soc. (London), pp. 1088–1089 (1970).

*Primary Examiner*—Nathan M. Nutter
*Attorney, Agent, or Firm*—Glenn E. Karta

[57] ABSTRACT

An antioxidant for lubricating oils comprising an amine compound selected from substituted benzylamines or a substituted 1-amino-1,2,3,4-tetrahydro-naphthalene. The preferred anti-oxidants are N-(alpha -methyl -p -octylbenzyl) aniline, N-(alpha-methylbenzyl)- p -nonylaniline or 1-( p -dodecylanilino)-1,2,3,4-tetrahydronaphthalene.

13 Claims, No Drawings

ANTIOXIDANT FOR POLYESTER FLUIDS - ALPHA - METHYL - N PHENYLBENZENEMETHANAMINE

This is a continuation of application Ser. No. 701,884 filed March 11, 1985 and which is a continuation of application Ser. No. 198,085 filed October 17, 1980 now abandoned which is a continuation of application Ser. No. 043,996 filed May 31, 1979 now abandoned.

BACKGROUND OF THE INVENTION

Advanced automotive, aircraft and other industrial equipment require lubricating oils that are effective at elevated temperatures. Polyesters, polyolefins, polyglycols, polyphenyl ethers, phosphates, silicones, etc. have been used as suitable lubricating oils. These lubricating oils undergo oxidative degradation at elevated temperatures. Loss of lubricating properties due to oxidative breakdown of these oils may cause failure of a part, or parts, in contact with the oils. The prior art discloses the stabilization of lubricating oils using various amines including diphenyl- and substituted diphenylamines, p-phenylenediamine and substituted naphthylamine. There appears to be no recognition of the use of secondary amines wherein one of the groups attached the amino nitrogen is an aromatic or substituted aromatic ring and the other group is an aliphatic carbon which in turn is attached to an aromatic or substituted aromatic ring.

U.S. Pat. No. 1,469,245 discloses N-(o-Hydroxybenzyl)-N'-phenyl-p-phenylene diamine as an anti-degradant for rubber. This compound belongs to the class of phenylene diamines which are known antioxidants. Furthermore, its use as a stabilizer for lubricating oils is neither disclosed in that patent, nor elsewhere.

U.S. Pat. No. 2,108,147 teaches a method for preparing secondary and teritary amines including 1-anilino-1-phenylethane. Hickenbottom teaches a phenylamine compound designated as alpha-phenylethyl-p-toluidine; see *Journal of the Chemical Society* (1934) pages 319–322. Beilstein discloses a phenyl amine compound of the general formula

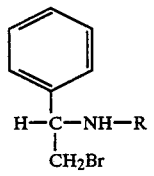

wherein R can be phenyl; see *Handbuch Der Organishen Chemie* 4th Ed., Vol XII Pat. IV pages 2403–4. None of the aforegoing compounds are taught to be antioxidants.

SUMMARY OF THE INVENTION

It has surprisingly been found that certain amino compounds are effective as antioxidants. These amino compounds have the general formula (I)

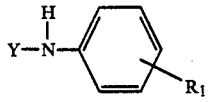

wherein Y is:

-continued (II)

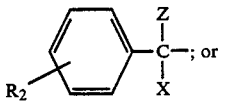

(III)

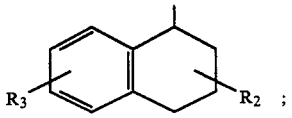

When Y is the moiety of formula (II), Z is H or $C_1$ to $C_3$ alkyl; and X and $R_2$ are each independently selected from the group consisting of hydrogen, $C_1$–$C_{12}$ alkyl, $C_1$–$C_{12}$ alkoxy; $C_2$–$C_{18}$ carbalkoxy, halogen, or nitro and $R_1$ is hydrogen, $C_1$–$C_{12}$ alkyl, $C_1$–$C_{12}$ alkoxy, $C_2$–$C_{18}$ carbalkoxy, halogen, amino or nitro. When Y is the moiety of formula (III), $R_1$ and $R_3$ are each independently selected from the group of moieties set forth as $R_1$ above and $R_2$ is as previously defined.

The compounds of this invention are novel compounds when X and Z are each independently selected from the group H and $C_1$–$C_3$ alkyl; and $R_1$ and $R_2$ are as previously defined except that they may not simultaneously be hydrogen when Z is hydrogen.

In its preferred embodiment the antioxidants of this invention are used in conjunction with a metal deactivator and a metal or metal salt. The preferred metal salts are oil soluble organic salts, e.g., metal naphthenates.

DETAILED DESCRIPTION OF THE INVENTION

This invention relates to a compound for the stabilizing lubricating oils against oxidation and sludge formation. In particular this invention relates to stabilizing such oils utilizing phenylated benzylamines or phenylated tetrahydro naphthylamines, which may be substituted or unsubstituted, either alone or in conjunction with a metal deactivator and a metal compound. This stabilizer system provides a surprisingly high degree of resistance to oxidative breakdown of lubricating oils as well as resulting in dramatic reductions in sludge formation. Certain of the phenylated benzylamines and phenylated tetrahydro naphthylamines used in the practice of this invention are novel compounds.

This invention relates to stabilizing a lubricating oil utilizing as the stablizer an antioxidant which is an amino compound having the general formula (I)

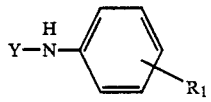

wherein Y is:

(II)

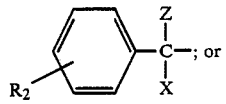

(III)

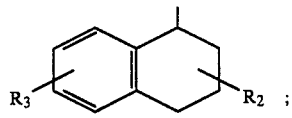

When Y is the moiety of formula (II), Z and X are each independently selected from the group consisting of H or $C_1$ to $C_3$ alkyl; $R_2$ is selected from the group consisting of hydrogen, $C_1$ to $C_{12}$ alkyl, $C_1$–$C_{12}$ alkoxy; $C_2$–$C_{18}$ carbalkoxy, halogen, or nitro and $R_1$ is hydrogen, $C_1$–$C_{12}$ alkyl, $C_1$–$C_{12}$ alkoxy, $C_2$–$C_{18}$ carbalkoxy, halogen, amino or nitro. When Y is the moiety of formula (III), $R_1$ and $R_3$ are each independently selected from the group of moieties set forth as $R_1$ above and $R_2$ is as previously defined.

The compounds of this invention are novel compounds when X and Z are each independently selected from the group consisting of H and $C_1$–$C_3$ alkyl; and $R_1$ and $R_2$ are as previously defined except that they may not be simultaneously hydrogen when Z is hydrogen. In its preferred embodiment Z is H or methyl and X is methyl.

Illustrative non-limiting examples of the novel antioxidants of this invention are N-(alpha-methyl-p-octylbenzyl)aniline;
N-(alpha-methyl-p-nonylbenzyl)aniline;
N-(alpha-methyl benzyl)-p-nonylaniline;
N-(alpha-methyl benzyl)-p-dodecylaniline;
N-(alpha-methyl benzyl)-p-methoxyaniline;
N-(alpha-methyl benzyl)-m-methoxyaniline;
N-(alpha-methyl benzyl)-o-methoxyaniline;
N-(alpha-methyl benzyl)-m-carbethoxyaniline;
N-(alpha-methyl benzyl)-o-carbethoxyaniline;
N-(alpha-methyl benzyl)-p-chloroaniline;
N-(alpha-methyl benzyl)-m-chloroaniline;
N-(alpha-methyl benzyl)-o-chloroaniline;
N-(alpha,alpha-dimethylbenzyl)aniline
1-(p-dodecylanilino)-1,2,3,4-tetrahydronaphthalene;
1-(p-carbethoxyanilino)-1,2,3,4-tetrahydronaphthalene;
N-(p-acetyl-alpha-methyl benzyl)aniline; and
1,4-bis-(1-anilinoethyl)benzene.

The preferred antioxidants of this invention are
N-(alpha-methyl-p-octylbenzyl)aniline and
N-(alpha-methyl benzyl)-p-nonylaniline.

Addition of the amines described above to lubricating oils imparts an unexpectedly high degree of resistance to oxidative breakdown.

The amines of this invention are useful in stabilizing a wide range of lubricating oils including polyester oils, mineral oils and synthetic hydrocarbon oils. The stabilizer system of this invention is particularly effective for use in polyolester lubricating oils.

The polyolester lubricating oils for which the stabilizer systems of this invention are suitable are synthetic lubricants based upon one or more organic carboxylic acid esters. Illustrative examples of such oils are diesters such as dioctyl sebacate or dinonyl adipate prepared by the reaction of a dibasic acid and a monohydric alcohol; triesters such as trimethylolpropane tripelorgonate or trimethylolpropane tricaprilate prepared by the reaction of trimethylol propane and a monobasic acid; tetraesters such as pentaerythritol tetracaprilate prepared by the reaction of pentaerythritol and a monobasic acid; esters of trimethylolpropane or pentaerythritol prepared by reaction with mixtures of monobasic acids; or complex esters prepared by reacting mixtures of monobasic acids, dibasic acids and polyhydric alcohols.

The synthetic hydrocarbon oils to which the stabilizer system of this system of this invention may be added are oligomers of alpha olefins. The preferred alpha olefins are $C_3$–$C_{14}$ alphaolefins. Normally, these hydrocarbon oils have a number average molecular weight of about 280 to about 2,000; preferably about 350 to about 1,500. These lubricating oils have low unsaturation preferably having an iodine number of less than 3.

The term "antioxidant" when used in the specification and claims means the substituted phenylated amines and substituted tetrahydronaphthylamines of this invention. The term "stabilizer system" as used in the specification and claims means the aforegoing antioxidants in conjunction with a metal compound and a metal deactivator.

The metal may be present either as the free metal or a salt of a metal. The salt must be soluble in the lubricating oil and is preferably an organometallic salt.

The preferred salts include naphthenates, stearates, acetylacetonates, octoates, decanoates etc.

The metal deactivators useful in the practice of this invention are benzotriazole and benzotriazole derivatives. The benzotriazole derivative can be alkyl substituted or dialkyl amino alkyl substituted; preferably dialkyl amino alkyl substituted. Substitution is on the secondary nitrogen of the triangle. The alkyl group can be a $C_1$ to $C_{20}$ alkyl and each alkyl may be the same or different than the others. Preferably the alkyl groups are selected to give the benzotriazole derivative sufficient oil solubility to be incorporated into the lubricant in an effective amount e.g. $C_6$–$C_{12}$ alkyl. Typical of such compounds is Reomet 38 marketed by Ciba Geigy Co. The term "metal deactivator" as used in the specification and claims means a compound which when added to a lubricant will neutralize the catalytic effect of metals e.g. copper in promoting oxidation.

The various components of the antioxidant system which may be added in any order are used in the following amounts. The antioxidant of this invention is used in amounts varying from about 0.5 to about 5.0 parts by weight per 100 parts of the oil, preferably, about 1.0 to about 4.0 parts; more preferably 2.0 to 2.5 parts. The metal deactivators can be used in amounts of about 0.05 to about 1.0 part by weight per 100 parts of the oil, preferably, 0.1 to 0.3 part. Metal or metal salts are used in the amounts of about 1 to about 25 parts of metal by weight per million parts of the oil; preferably 2 to 10 parts. The preferred metal is copper.

The criteria used herein to evaluate the effectiveness of an antioxidant for lubricating oils are:

(1) the amount of sludge produced,
(2) the change in initial viscosity,
(3) the change in neutralization number; and,
(4) the weight change of the test metals.

These criteria are determined after the oil containing the antioxidant system of this invention has been aged for 72 hours at 370° F. or after the oil containing the antioxidant system has been aged for 48 hours at 425° F.

The benefits of the antioxidants and stabilizers of this invention may be more readily appreciated by reference to the following examples. The term "polyolester" as used in the specification and claims means a polyester prepared from a polyol by reacting the polyol with a stochiometric equivalent of mono basic acids.

EXAMPLE 1

This example shows the unexpected ability of the antioxidant of the present invention to protect polyester based lubricating oils against oxidative degradation. The oil used was a commercially available polyolester fluid, Hercolube A (marketed by Hercules Inc.) and believed to be one prepared from pentaerythritol and a mixture of monocarboxylic acids, e.g., valeric acid and pelargonic acid.

Experiments were carried out in order to evaluate the effectiveness of the antioxidant. The oil sample used in runs B and C was prepared by adding N-(alpha-methylbenzyl)aniline in the amount set forth in Table I to 100 grams of the polyolester based oil. Sample D was similarly prepared containing phenyl alpha-naphthylamine, a commercially available stabilizer. The amounts used in each case are set forth in Table I.

Each of the samples was tested according to the following test procedures:

A 100 ml. sample having the compositions set forth in Table I is poured into a pyrex glass test cell and aged by inserting one end of a glass air delivery tube into the test cell while the remaining 25 ml. portions of each original oil sample is set aside and analyzed for neutralization number and Kinematic Viscosity in centistokes at 100° F. Around this glass air delivery tube immersed in the oil was placed from zero to four metal washers (Mg, Cu, Ag, and Fe) as identified in Table I. When more than one washer was used, they were separated from each other by glass spacers. These remained in the oil during the aging process and served to indicate the extent of corrosion of the oil oxidative decomposition products on the metal. The test cell was then fitted with a reflux condenser. The assembly was placed in a constant temperature aluminum block. An air hose was then attached to the other end of the air delivery tube and the air flow was adjusted so that five liters of air per hour was bubbled through the oil. This aging test was carried out for 48 hours at 425° F. After aging, the oil was filtered hot and the amount of sludge developed was collected and was determined and recorded in milligrams per 100 ml. of the oil. The filtered oil was then analyzed to determine changes in neutralization number and Kinematic Viscosity at 100° F.

The neutralization number was determined by the color-indicator titration method according to ASTM Procedure D974-55T.

The Kinematic Viscosity was determined according to ASTM Procedure D445-53T.

The metal washers, which were weighed initially, were then carefully washed and weighed again to determine the weight change in grams.

The data in Table I dramatically show that when an amine such as N-(alpha-methybenzyl)aniline is added to a polyolester based lubricating oil the aged properties of oil Samples B and C are excellent as noted by very little change in the viscosity or neutralization number, very low sludge and essentially no weight change in the metals. The amine antioxidant clearly provides better all around protection than a commercially available stabilizer (Sample D).

It should be noted that Sample C, wherein the test was conducted in the presence of copper, was slightly more deteriorated than Sample B, where no copper was present.

TABLE I

| RUN # | OIL[1] | STABILIZER SYSTEM | GRAMS OF STABILIZER | % $\Delta V_{1002}$ | N.N.[3] | SLUDGE (in mg.) | WEIGHT CHANGE (in grams) OF WASHERS Mg | Fe | Cu | Ag |
|---|---|---|---|---|---|---|---|---|---|---|
| A | 100 | — | — | 94.9[4] | 26.2 | Undetermined | −0.1366 | −0.0052 | −0.0091 | −0.0001 |
| B | 100 | 5 | 2.0 | 13.68 | 2.7 | 5.1 | −0.0001 | +0.0003 | * | −0.0017 |
| C | 100 | 5 | 2.0 | 18.81 | 2.64 | 19.7 | +0.0001 | −0.0004 | −0.0011 | −0.0001 |
| D | 100 | 6 | 2.0 | 31.5 | 2.2 | 135.7 | −0.0130 | 0.0000 | −0.0024 | −0.0001 |

*no metal included

LEGEND:

[1]Oil - Commercially available, Hercolube A.

[2]$\%/V_{100}$- Percent in viscosity at 100° F.

[3]N.N. - Neutralization Number of aged oil.

[4]Aged oil was so viscous that it could not be completely filtered to determine the amount of sludge formed. Neutralization number and viscosity of the aged oil are actually the properties of a small sample that could be filtered.

[5]N-(alpha-methylbenzyl)aniline

[6]Phenyl- alpha- naphthylamine

EXAMPLE II

This example demonstrates the effect of the addition of and changes in the levels of a metal deactivator such as Reomet-38, a benzotriazole derivative marketed by Ciba Geigy Co., on the stabilization of a polyolester based lubricating oil while the level of N-(alpha-methylbenzyl)aniline and copper are maintained constant. The samples were prepared as in EXAMPLE I.

The data in Table II shows that the addition of Reomet-38 at the levels tested is effective in controlling viscosity change, neutralization number change and sludge formation. The data further demonstrates that the addition of Reomet-38 dramatically controls the weight loss of the copper washer.

The data in Table II also shows that the addition of even low levels of the metal deactivator (samples B and C) provide better protection than when no deactivator is used (sample A).

TABLE II

| SAMPLE[1] | ANTIOXIDANT[2] (grams) | R-38[3] (grams) | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|
| A | 2.0 | 0.00 | 18.81 | 2.64 | 19.7 | +0.0001 | +0.0004 | −0.0011 | +0.0001 |
| B | 2.0 | 0.07 | 12.04 | 1.65 | 5.2 | +0.0001 | 0.0000 | −0.0004 | 0.0000 |
| C | 2.0 | 0.08 | 6.99 | 1.66 | 6.5 | 0.0000 | 0.0000 | −0.0003 | −0.0004 |
| D | 2.0 | 0.30 | 7.61 | 1.60 | 6.7 | 0.0000 | +0.0003 | −0.0001 | −0.0002 |
| E | 2.0 | 0.50 | 18.42 | 4.20 | 9.2 | −0.0001 | +0.0002 | +0.0003 | +0.0004 |

NOTES:

[1]100 ml. of Hercolube A is used.

[2]Antioxidant N-(alpha-methylbenzyl)aniline

[3]R-38: Reomet-38 is used as metal deactivator (a commercially available material from Ciba-Geigy Chemical Co.)

EXAMPLE III

This example dramatically demonstrates that Reomet-38 cannot be included in the stabilizing system without incorporating copper either in the form of a soluble salt or in the form of a metal strip, washer, wire, etc. This example further shows how changes in the level of copper while maintaining constant N-(alpha-methylbenzyl)aniline and Reomet-38 levels effects stabilization. The samples were prepared as in EXAMPLE I.

The data in Table III shows that a stabilizer system containing N-(alpha-methylbenzyl)aniline and Reomet-38 is ineffective in the absence of copper (Sample A, Table III) in decreasing the amounts of sludge, maintaining low viscosity, low neutralization number, and protecting the metal washers from oxidation. In the absence of copper, Reomet 38 functions as a pro-degradant. The data in Table III further shows that increasing amounts of copper above 10 ppm causes the stabilizer system to exhibit a decrease in its efficiency in controlling oxidative breakdown.

Clearly Sample II-D illustrates that when the amine, a metal deactivator and copper are present, the greatest protection is afforded to the oil. Sample I-B (amine but no copper), Sample I-C (amine and copper) and most dramatically Sample III-A (amine and metal deactivator but no copper) all show decreased protection when compared with II-D where all three components of the instant invention are present in the system.

TABLE IV

| SAMPLE[1] | ANTIOXIDANT[2] (grams) | R-38[3] (grams) | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|
| A (Table I) | — | — | 94.9** | 26.2 | * | −0.1366 | −0.0052 | −0.0091 | −0.0001 |
| B (Table I) | 2.0 | — | 13.68 | 2.7 | 5.1 | −0.0001 | +0.0003 | * | −0.0017 |
| C (Table I) | 2.0 | — | 18.81 | 2.64 | 19.7 | +0.0001 | −0.0004 | −0.0011 | +0.0001 |
| D (Table II) | 2.0 | 0.3 | 7.61 | 1.6 | 6.7 | 0.0000 | +0.0003 | −0.0001 | −0.0002 |
| A (Table III) | 2.0 | 0.3 | 32.05 | 5.6 | 560.7 | −0.0594 | +0.0007 | * | −0.0001 |

NOTES:
[1]100 ml. of Hercolube A is used.
[2]Antioxidant N-(alpha-methylbenzyl)aniline.
[3]R-38: Reomet-38 is used as metal deactivator. (a commercially available material from Ciba-Geigy Chemical Co.)
*No metal included
**Aged oil was so viscous that it could not be completely filtered to determine the amount of sludge formed. Neutralization number and viscosity of the aged oil is actually the properties of a small sample that could be filtered.

TABLE III

| SAMPLE[1] | ANTIOXIDANT[2] (grams) | R-38[3] (grams) | Cu[4] | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|---|
| A | 2.0 | 0.3 | — | 32.05 | 5.6 | 560.7 | −0.0594 | +0.0007 | | −0.0001 |
| B | 2.0 | 0.2 | Washer | 15.66 | 1.58 | 5.7 | +0.0001 | +0.0001 | −0.0001 | −0.0003 |
| C | 2.0 | 0.2 | 1 ppm | 12.64 | 0.53 | 19.3 | +0.0003 | +0.0001 | | +0.0001 |
| D | 2.0 | 0.2 | 10 ppm | 9.14 | 1.6 | 40.9 | +0.0003 | +0.0001 | | −0.0001 |
| E | 2.0 | 0.2 | 30 ppm | 23.15 | 1.7 | 98.5 | −0.0002 | +0.0002 | | −0.0001 |
| F | 2.0 | 0.3 | Washer | 7.61 | 1.6 | 6.7 | 0.0000 | +0.0003 | −0.0001 | −0.0002 |
| G | 2.0 | 0.3 | 30 ppm | 15.33 | 1.59 | 173.3 | −0.0116 | +0.0001 | −0.0003 | −0.0002 |
| H | 2.0 | 0.3 | 200 ppm | 20.8 | 7.61 | 582.2 | +0.0373 | +0.0001 | −0.0015 | −0.0003 |

NOTES:
[1]100 ml. of Hercolube A is used.
[2]Antioxidant N-(alpha-methylbenzyl)aniline.
[3]R-38: Reomet-38 is used as metal deactivator.
[4]Cu: Copper is added as copper naphthenate.

EXAMPLE IV

This example utilizes data presented in Examples I, II and III to demonstrate the essence of the instant invention. See Table IV.

EXAMPLE V

This example demonstrates how the stabilization of a polyolester based lubricating oil is affected by changes in the level of N-(alpha-methylbenzyl)aniline while maintaining constant Reomet-38 level in the presence of a constant amount of copper metal. The samples were prepared as in EXAMPLE I, using the amounts of ingredients as shown in Table V.

The data in Table V show that when a level of about 2.0 to 3.0 parts of N-(alpha-methylbenzyl)aniline was used together with 0.2 part of Reomet-38, a polyolester based lubricating oil is effectively stabilized. The preferred level of N-(alpha-methylbenzyl)aniline is shown to be from 2.0 to 2.5 parts.

It can be seen from the results of Table V that the level of the N-(alpha-methylbenzyl)aniline is critical in producing polyolester based lubricating oils having outstanding aged physical properties while maintaining Reomet-38 at a constant level.

TABLE V

| SAMPLE | OIL[1] | ANTIOXIDANT[2] (grams) | R-38[3] (grams) | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|---|
| A | 100 | 1.5 | 0.2 | 23.91 | 5.4 | 694.8 | −0.0521 | +0.0002 | +0.0002 | +0.0001 |
| B | 100 | 2.0 | 0.2 | 17.13 | 1.4 | 10.9 | 0.0000 | 0.0000 | +0.0001 | −0.0001 |
| C | 100 | 2.2 | 0.2 | 14.03 | 1.1 | 9.5 | −0.0001 | 0.0000 | +0.0002 | +0.0001 |
| D | 100 | 2.5 | 0.2 | 18.62 | 1.1 | 10.0 | +0.0001 | +0.0002 | +0.0002 | 0.0000 |

TABLE V-continued

| SAMPLE | OIL[1] | ANTIOXIDANT[2] (grams) | R-38[3] (grams) | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|---|
| E | 100 | 3.0 | 0.2 | 9.64 | 1.1 | 30.9 | −0.0026 | +0.0002 | +0.0001 | +0.0002 |

NOTES:
[1]-Oil - Commercially available, polyolester based lubricating oil, Hercolube A.
[2]-N-(alpha-methylbenzyl)aniline.

EXAMPLE VI

This example demonstrates how various substituted N-benzylanilines effect the stabilization of a polyolester based oil while maintaining a constant Reomet-38 level in the presence of a constant amount of copper metal.

Substituted N-benzylanilines were prepared by catalytic hydrogenation of the corresponding Schiff's bases. Five percent Pd/c was used as the catalyst and ethanol was used as the solvent for hydrogenating the Schiff's bases. Schiff's bases, in turn, were prepared by the reaction of the appropriate ketones and anilines in the presence of molecular seives. About 40 grams of molecular sieves (Linde 5A) were added to 1.0 mole of ketone and 1.0 to 1.2 moles of aromatic amine in 200 ml. of benzene; see Kazuo Taguchi and F. H. Westheimer, J. ORG. CHEM. 36, 1570 (1971). The reaction mixture was refluxed with continuous removal of water until almost no free ketone could be detected in the reaction mixture by I. R. spectroscopy. The mixture was then filtered and the molecular seives washed with benzene. The filtrate and washings were combined and evaporated to dryness under reduced pressure. The crude product was purified by either crystallization or by vacuum distillation.

The samples were prepared and tested as in EXAMPLE I using the amounts of ingredients as shown in Table VI.

The data in Table VI clearly show that substituted benzylanilines of this invention stabilize polyolester based lubricating oils with respect to oxidative breakdown.

Substitution on the aromatic ring of the benzyl group seems to have little adverse effect.

TABLE VI

EFFECT OF SUBSTITUENTS IN N-BENZYLANILINES

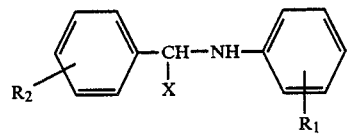

| Run No. | $R_2$ | $R_1$ | X | R-38 (grams) | AGED N.N. | % $\Delta V_{100}$ | SLUDGE mg/100 ml |
|---|---|---|---|---|---|---|---|
| 1 | H | p-$COOC_2H_5$ | $CH_3$ | 0.2 | 1.6 | 37.96 | 1,096.4 |
| 2 | H | m-$COOC_2H_5$ | $CH_3$ | 0.2 | 6.03 | 40.17 | 1,625.0 |
| 3 | H | p-$OCH_3$ | $CH_3$ | 0.2 | 5.4 | 32.22 | 1,294.1 |
| 4 | H | m-$OCH_3$ | $CH_3$ | 0.2 | 2.2 | 41.84 | 25.2 |
| 5 | H | o-$OCH_3$ | $CH_3$ | 0.2 | 7.5 | 39.09 | 146.2 |
| 6 | H | p-$C_{12}H_{25}$ | $CH_3$ | 0.2 | 10.0 | 370.61 | 32.0 |
| 7 | H | p-Cl | $CH_3$ | 0.2 | 4.3 | 33.49 | 33.1 |
| 8 | H | m-Cl | $CH_3$ | 0.2 | 7.7 | 25.81 | 568.3 |
| 9 | H | o-Cl | $CH_3$ | 0.2 | 9.8 | 29.30 | 606.9 |
| 10 | p-$CH_3$ | H | $CH_3$ | 0.2 | 1.1 | 11.24 | 6.6 |
| 11 | p-$CH_3$ | H | $CH_3$ | 0.2 | 3.7 | 29.50 | 13.9 |
| 12 | H | H | $CH_3$ | 0.2 | 1.0 | 17.13 | 6.9 |
| 13 | H | H | $CH_2CH_2CH_3$ | 0.2 | 7.3 | 25.31 | 606.0 |
| 14 | | | | | 26.2 | 94.97 | COULD NOT BE FILTERED |
| 15 | H | p-$COOC_{12}H_{25}$ | $CH_3$ | 0.2 | 2.7 | 36.11 | 2.8 |

| Run No. | WEIGHT CHANGE (in grams) OF WASHERS Mg | Fe | Cu | Ag | Remarks |
|---|---|---|---|---|---|
| 1 | −0.0634 | −0.0002 | −0.0018 | 0.0000 | B |
| 2 | −0.0683 | −0.0002 | −0.0014 | −0.0003 | B |
| 3 | −0.0523 | 0.0000 | −0.0001 | 0.0000 | B |
| 4 | −0.0455 | 0.0000 | −0.0036 | −0.0002 | B |
| 5 | −0.0500 | +0.0010 | −0.0036 | −0.0002 | B |
| 6 | −0.0877 | +0.0001 | −0.0002 | 0.0000 | C |
| 7 | −0.0419 | +0.0001 | −0.0048 | −0.0051 | B |
| 8 | −0.0203 | 0.0000 | −0.0040 | −0.0008 | B |
| 9 | −0.0163 | −0.0012 | −0.0077 | −0.0017 | B |
| 10 | −0.0001 | −0.0030 | −0.0002 | −0.0001 | B |
| 11 | −0.0001 | −0.0004 | −0.0002 | −0.0004 | B |
| 12 | −0.0001 | −0.0002 | −0.0001 | −0.0001 | B |
| 13 | −0.0620 | −0.0002 | −0.0002 | −0.0001 | B |
| 14 | −0.1366 | −0.0052 | −0.0091 | −0.0001 | A |

TABLE VI-continued

| EFFECT OF SUBSTITUENTS IN N-BENZYLANILINES | | | | | |
|---|---|---|---|---|---|
| 15 | 0.0000 | −0.0001 | −0.0007 | −0.0002 | D |

NOTES:
A. No antioxidant is used. In other experiments, with the exception of Run 14, 2.0 g of substituted N-benzylaniline is used.
B. Hercolube A (100 ml) is used for each test.
C. Hercolube A (50 ml) is used for this test.
D. 3.5 g of the antioxidant is used.

EXAMPLE VII

A preferred embodiment of this invention involves alkylation in the benzyl ring and/or the aniline ring of the parent alpha-methyl benzyl aniline. This is beneficial in that it results in decreased volatility of the parent compound. Thus, such compounds as

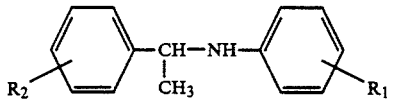

where $R_2$ can be H, or a $C_1$ to $C_{12}$ alkyl group and $R_1$ can be H or a $C_4$ to $C_{12}$ alkyl group; provided that $R_1$ and $R_2$ are not simultaneously both hydrogen. $R_2$ can be a $C_1$ to $C_{12}$ alkyl group which may or may not be branched. $R_1$ can be an alkyl group, preferably in the para-position or a tertiary alkyl group such as those derived from isobutylene, isobutylene dimer, isobutylene trimer, propylene trimer, alpha-methyl styrene and the like.

TABLE VII

| SAMPLE[1] | ANITOXIDANT[2] (grams) | R-38[3] (grams) | % $\Delta V_{100}$ | N.N. | SLUDGE (mg) | WEIGHT CHANGE (in grams) OF WASHERS Mg | Fe | Cu | Ag |
|---|---|---|---|---|---|---|---|---|---|
| A | 2.5 | 0.2 | 20.8 | 3.5 | 16.7 | +0.0001 | +0.0002 | −0.0006 | 0.0000 |
| B | 3.0 | 0.2 | 25.2 | 2.6 | 13.9 | +0.0001 | +0.0002 | −0.0004 | −0.0001 |
| C | 3.5 | 0.2 | 16.4 | 1.5 | 5.7 | 0.0000 | +0.0002 | 0.0000 | 0.0000 |

NOTES:
[1]100 ml. of Hercolube A is used.
[2]Antioxidant N-(alpha-methyl-p-octyl)benzylaniline.
[3]R-38: Reomet-38 is used as metal deactivator.

EXAMPLE VIII

This example shows how phenylated-alpha-tetralylamine affects the stabilization of a polyolester based lubricating oil.

The phenylated-alpha-tetralylamines were prepared according to the procedure described in EXAMPLE VI.

The samples were prepared as in Example I using the amounts of ingredients as shown in Table VIII.

The data in Table VIII shows that the addition of phenylated-alpha-tetralylamine, a metal deactivator and copper or a copper salt to a polyolester lubricating oil such as Hercolube A stabilizes the said oil against oxidative breakdown.

TABLE VIII

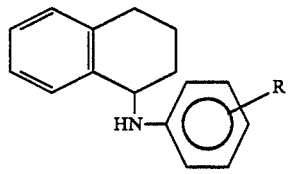

| Run No. | R | R-38 (grams) | A.O. (grams) | OIL | CHANGE in N.N. | % $\Delta V_{100}$ | SLUDGE (in mg) |
|---|---|---|---|---|---|---|---|
| 1 | H | 0.2 | 2.5 | 100 | 5.3 | 24.51 | 34.3 |
| 2 | H | 0.5 | 2.0 | 100 | 3.7 | 32.31 | 49.7 |
| 3 | H | 0.2 | 2.0 | 100 | 3.7 | 27.70 | 29.6 |
| 4 | H | 0.5 | 1.5 | 100 | 12.1 | 40.38 | 36.6 |
| 5 | H | 0.5 | 1.0 | 100 | 10.4 | 39.57 | 38.9 |
| 6 | H | 0.5 | 3.0 | 100 | 3.2 | 33.23 | 275.9 |
| 7 | p-$C_{12}H_{25}$ | 0.5 | 1.0 | 100 | 6.2 | 65.50 | 1,964.2 |
| 8 | p-$C_{12}H_{25}$ | 0.5 | 2.0 | 100 | 8.4 | 44.88 | 21.9 |
| 9 | p-$C_{12}H_{25}$ | 0.5 | 3.5 | 100 | 5.4 | 30.06 | 14.9 |
| 10 | p-$OCH_3$ | 0.5 | 0.9 | 100 | 13.0 | 29.75 | 5,504.2 |
| 11 | p-$COOC_2H_5$ | 0.5 | 2.0 | 100 | 4.4 | 28.42 | 7.0 |
| 12 | — | 0 | 0 | 100 | 16.7 | 39.57 | * |

| Run No. | WEIGHT CHANGE (in grams) OF WASHERS Mg | Fe | Cu | Ag |
|---|---|---|---|---|
| 1 | 0.0000 | +0.0001 | +0.0002 | +0.0001 |
| 2 | +0.0003 | +0.0004 | +0.0003 | +0.0001 |
| 3 | +0.0003 | +0.0004 | +0.0004 | +0.0002 |
| 4 | +0.0002 | +0.0006 | +0.0001 | +0.0002 |
| 5 | +0.0002 | +0.0005 | 0.0000 | +0.0002 |
| 6 | +0.0008 | +0.0012 | +0.0030 | +0.0005 |

TABLE VIII-continued

| | | | | |
|---|---|---|---|---|
| 7 | −0.9870 | +0.0002 | +0.0001 | +0.0002 |
| 8 | +0.0002 | +0.0002 | +0.0002 | −0.0003 |
| 9 | +0.0003 | +0.0003 | +0.0006 | +0.0004 |
| 10 | −0.0017 | −0.0017 | −0.0002 | +0.0004 |
| 11 | +0.0001 | +0.0001 | +0.0001 | +0.0001 |
| 12 | −0.1000 | −0.0020 | −0.0495 | −0.0001 |

NOTE:
*Too viscous to filter. N.N. and viscosity were taken on a few milliliters.

EXAMPLE IX

To 100 parts of polydecene synthetic hydrocarbon oil is added 2.0 parts of 1-(p-dodecylanilino)-1,2,3,4-tetrahydronaphthalene and 0.5 part Reomet 38. Oxidative testing of the oil as described in Example II-E show that the above combination effectively protects synthetic hydrocarbon oils against oxidative breakdown.

EXAMPLE X

To 100 parts of mineral oil is added 2.0 parts of N-(alpha-methylbenzyl)-aniline and 0.5 parts Reomet 38 as in Example II.E. The resulting blend is found also to exhibit excellent antioxidant properties when an aging test is performed at elevated temperatures.

EXAMPLE XI

To 100 parts of polyoctene synthetic hydrocarbon oil is added 2.0 parts of N-(alpha-methylbenzyl)aniline and 0.5 parts Reomet 38 as in Example II.E. The resulting blend is found to exhibit excellent antioxidant properties when an aging test is performed at elevated temperatures.

EXAMPLE XII

To 100 parts of polydecene synthetic hydrocarbon oil is added 2.0 parts of N-(alpha-methylbenzyl)aniline and 0.5 parts Reomet 38 as in Example II.E. The resulting blend exhibits excellent antioxidant properties when aging is performed at elevated temperatures.

EXAMPLE XIII

To 100 parts of a blend of 25 parts polyoctene and 75 parts trimethylol propane triheptanoate synthetic ester fluid is added 2.0 parts of N-(alpha-methylbenzyl) aniline and 0.5 parts Reomet 38 as in Example II.E. The resulting blend possesses excellent antioxidant properties when aging is performed at elevated temperatures.

EXAMPLE XIV

To 100 parts of a blend of 50 parts of polyoctene and trimethylol propane triheptanoate synthetic ester fluid is added 2.0 parts of N-(alpha-methylbenzyl)aniline and 0.5 parts Reomet 38 as in Example II.E. The resulting blend is found to exhibit excellent antioxidant properties when aging is performed at elevated temperatures.

EXAMPLE XV

A. A solution of p-nonyl acetophenone (90 g), aniline (75 g), Toluene (125 ml) and pyridine (20 ml) was refluxed with continuous removal of water. N-(alpha-methyl-p-nonyl benzylidene) aniline (XXX) was obtained by fractional distillation. XXX had a boiling point of 200°-208° at 0.075 millimeter.

Analysis calculated for $C_{23}H_{31}N$: C, 85.92; H, 9.72; N, 4.36. Found: C, 87.12; H, 10.07; N, 3.91.

B. N-alpha-methyl-p-nonyl benzylidene) aniline (XXX) (40 g) prepared by the procedure described in Example XVI A was hydrogenated using 5% Pd/C as the catalyst and 95% ethanol as the solvent. N-(alpha-methyl-p-nonyl benzyl) aniline (XXXI) was obtained by fractional distillation. XXXI had a boiling point of 183° C. at 0.15 millimeter.

EXAMPLE XVI

A solution of alpha, alpha-dimethyl benzyl alcohol (73 g), aniline (150 g), toluene (150 ml) and p-toluene sulfonic acid (2.0 g) was refluxed with continuous removal of water. N-(alpha, alpha, dimethyl benzyl) aniline (XXXII) was obtained by fractional distillation. XXXII had a boiling point of 121° C. at 0.07 millimeter.

Analysis calculated for $C_{15}H_{17}N$: C, 85.26; H, 8.11; N, 6.63. Found: C, 85.08; H, 7.97; N, 7.03.

EXAMPLE XVII

A. A solution of p-octylacetophenone (100 g), aniline (85 ml), pyridine (20 ml) and toluene (200 ml) was refluxed with the continuous removal of water. The product was a mixture of unreacted p-octyl acetophenone, aniline, pyridine and the Schiff's base. The desired N-(α-methyl-p-octyl-benzylidene) aniline (I) (65 g) was separated from other components of the reaction mixture by fractional distillation. The desired product (I) had a boiling point of 192° C. at 0.1 millimeter.

B. N-(α-methyl-p-octyl benzylidene) aniline (49 g), prepared by the procedure described in Example IA was hydrogenated using 5% Pd/C as the catalyst and 95% ethanol as the solvent. N-(α-methyl-p-octyl-benzyl)aniline (II) (40.5 g) was obtained by fractional distillation. The desired product II had a boiling point of 173° to 178° C. at 0.025 millimeter.

Analysis calculated for $C_{22}H_{31}N$: C, 85.43; H, 10.03; N, 4.53. Found: C, 86.46; H, 10.58; N, 4.54.

EXAMPLE XVIII

A. Nonyl benzene was prepared by alkylating benzene with mixed propylene trimer using Friedel Crafts reaction. Nonyl benzene was nitrated and reduced to give p-nonyl aniline. A solution of p-nonyl aniline (30 g), acetophenone (60 g), toluene (200 ml) and pyridine (20 ml) was refluxed with continuous removal pf water. N-(α-methyl benzylidene)-p-nonyl aniline (III) was obtained by fractional distillation. III had a boiling point of 194° C. at 0.05 millimeter.

B. N-(α-methyl benzylidene)-p-nonyl aniline (III) (16.5 g) prepared by the procedure described in Example IIA was hydrogenated suing 5% Pd/C as the catalyst and 95% ethanol as the solvent. N-(α-methyl benzyl)-p-nonyl aniline (IV) was obtained by fractional distillation. IV had a boiling point of 180°-184° C. at 0.025 millimeter.

EXAMPLE XIX

A. solution of acetophenone (33.5 g), p-dodecyl aniline (73 g), benzene (50 ml) was refluxed in the presence of molecular sieve (100 g) with continuous removal of water. The crude product was purified by crystallizing it from ethanol to give N-(α-methyl benzylidene)-p-dodecyl aniline (V) (95 g). V had a melting point of 47° C.

Analysis calculated for $C_{26}H_{37}N$: C, 85.89; H, 10.26; N, 3.85. Found: C, 85.96; H, 10.55; N, 4.13.

B. N-(α-methyl benzylidene)-p-dodecyl aniline (80 g) prepared by the procedure described in Example IIIA was hydrogenated using 5% Pd/C as the catalyst and 95% ethanol as the solvent to give N-(α-methyl benzyl)-p-dodecyl aniline (VI). VI had a boiling point of 188° C. at 0.03 millimeter.

Analysis calculated for $C_{26}H_{39}N$: C, 85.42; H, 10.75; N, 3.83. Found: C, 85.49; H, 10.54; N, 4.01.

EXAMPLE XXI

A. A solution of acetophenone (64 ml), p-anisidine (65 mg), benzene (100 ml) was refluxed in the presence of molecular sieve (100 g) with continuous removal of water. The crude product was purified by crystallizing it from ethanol to give N-(αmethyl-benzylidene)-p-anisidine (VII) (50 g). VII had a melting point of 81°-82° C.

Analysis calculated for $C_{15}H_{15}NO$: C, 79.97; H, 6.71; N, 6.22. Found: C, 80.10; H, 6.78; N, 6.24.

B. N-(α-methyl benzylidene)-p-anisidine (VII) prepared by the procedure described in example IVA was hydrogenated using 5% Pd/C as the catalyst and 95% ethanol as the solvent to give N-(α-methyl benzyl)-p-anisidine (VIII). VIII had a melting point of 64° C.

Analysis calculated for $C_{15}H_{17}NO$: C, 79.26; H, 7.54; N, 6.16. Found: C, 79.98; H, 7.65; N, 6.22.

EXAMPLE XXII

A solution of acetophenone (120 ml), o-anisidine (123 ml), benzene (100 ml) was refluxed with continuous removal of water. The crude product was purified by crystallizing it from ethanol to give N-(αmethyl benzylidene)-o-anisidine (IX) (90 C). It was then hydrogenated using 5% Pd/C as the catalyst and 95% ethanol as the solvent to give N-(α-methyl benzyl)-o-anisidine (X). X had a boiling point of 117° C. at 0.3 millimeter.

Analysis calculated for $C_{15}H_{17}NO$: C, 79.26; H, 7.54; N, 6.16. Found: C, 79.42; H, 7.72; N, 6.32.

EXAMPLE XXIII

A. A solution of acetophenone (44 ml), ethyl-p-aminobenzoate (60 g), benzene (100 ml) was refluxed in the presence of molecular sieve (100 g) with continuous removal of water. The crude product was purified by crystallizing it from ethanol to give N-(α-methyl benzylidene)-p-carbethoxy aniline (XI). XI had a m.p. of 87° C.

Analysis calculated for $C_{17}H_{17}NO_2$: C, 76.38; H, 6.41; N, 5.24. Found: C, 76.59; H, 6.37; N, 5.33.

B. N-(α-methyl benzylidene)-p-carbethoxyaniline (XI) prepared by the procedure described in example XXIIA was hydrogenated using 5% Pd/C as the catalyst and 95% ethanol as the solvent to give N-(α-methyl benzyl)-p-carbethoxy aniline (XII). XII had a m.p. of 88° C.

Analysis calculated for $C_{17}H_{19}NO_2$: C, 76.38; H, 6.41; N, 5.24. Found: C, 76.58; H, 6.37; N, 5.33.

EXAMPLE XXIV

A. A solution of acetophenone (95 ml), m-carbethoxy aniline (75 ml), benzene (150 ml) was refluxed in the presence of molecular sieve (50 g) with continuous removal of water. The crude product was distilled under reduced pressure to give N-(α-methyl benzylidene)-m-carbethoxyaniline (XIII). XIII had a boiling point of 205° C. at 0.1 millimeter.

Analysis calculated for $C_{17}H_{17}NO_2$: C, 76.38; H, 6.41; N, 5.24. Found: C, 75.96; H, 6.34; N, 5.32.

B. N-(α-methyl benzylidene)m-carbethoxyaniline (27 g) prepared by the procedure described in example VIIA was hydrogenated using 5% Pd/C as the catalyst and 95% ethanol as the solvent. N-(α-methyl benzyl m-carbethoxy aniline (XIV) was obtained by fractional distillation. XIV had a boiling point of 156° C. at 0.1 millimeter.

Analysis calculated for $C_{17}H_{19}NO_2$: C, 76.38; H, 6.41; N, 5.24. Found: C, 75.60; H, 6.96; N, 5.36.

EXAMPLE XXV

A. A solution of acetophenone (100 ml), o-carbethoxyaniline (90 ml), benzene (100 ml) was refluxed in the presence of molecular sieve (40 g) with continuous removal of water. N-(α-methyl benzylidene)-o-carbethoxyaniline (XV) was obtained by fractional distillation. XV had a boiling point of 123° at 0.1 millimeter.

Analysis calculated for $C_{17}H_{17}NO_2$: C, 76.38; H, 6.41; N, 5.24.

B. N-(α-methyl benzylidene)-o-carbethoxyaniline (13 g) prepared by the procedure described in example XXVA was hydrogenated using 5% Pd/C as the catalyst and 95% ethanol as the solvent. N-(α-methyl benzyl)-o-carbethoxyaniline (XVI) (12 g) was obtained by fractional distillation. XVI had a boiling point of 168° C. at 1.4 millimeter.

Analysis calculated for $C_{17}H_{19}NO_2$: C, 76.38; H, 6.41; N, 5.24. Found: C, 76.50; H, 7.04; N, 5.28.

EXAMPLE XXVI

A solution of acetophenone (132 ml), p-chloroaniline (128 g) benzene (150 ml) was refluxed in the presence of molecular sieve (40 g) with continuous removal of water. The crude product was crystallized from ethanol to give p-chloro-N-(α-methyl benzylidene) aniline (XVII). It was then hydrogenated using 5% Pd/C as the catalyst and 95% ethanol as the solvent. The crude product was crystallized from ethanol and pet. ether to give p-chloro-N-(α-methyl benzyl) aniline (XVIII). XVIII had a melting point of 62° C.

Analysis calculated for $C_{14}H_{14}ClN$: C, 72.56; H, 6.08; N, 6.04. Found: C, 72.80; H, 6.19; N, 6.15.

EXAMPLE XXVII

A. A solution of acetophenone (130 ml), m-chloroaniline (130 ml) and benzene (200 ml) was refluxed in the presence of molecular sieve (50 g) with continuous removal of water. m-Chloro-N-(α-methyl benzylidene) aniline (XIX) was obtained by fractional distillation. XIX had a boiling point of 110° C. at 0.025 millimeter.

Analysis calculated for $C_{14}H_{12}ClN$: C, 73.20; H, 5.26; N, 6.09. Found: C, 73.60; H, 5.19; N, 6.23.

B. m-Chloro-N-(α-methyl benzylidene) aniline (XIX) (24 g) prepared by the procedure described in example XXVIIA was hydrogenated using 5% Pd/C as the catalyst and 95% ethanol as the solvent. m-Chloro-N-(α-methyl benzyl) aniline (XX) was obtained by fractional distillation. XX had a boiling point of 133° C. at 0.15 millimeter.

Analysis calculated for $C_{14}H_{14}ClN$: C, 72.56; H, 6.08; N, 6.04. Found: C, 72.63; H, 6.16; N, 6.26.

EXAMPLE XXVIII

A. A solution of acetophenone (130 ml), 2-chloroaniline (130 ml) and benzene (200 ml) was refluxed in the presence of molecular sieve with continuous removal of water. o-Chloro-N-(α-methyl benzylidene) aniline (XXI) was obtained by fractional distillation. XXI had a boiling point of 111° C. at 0.1 millimeter.

Analysis calculated for $C_{14}H_{12}ClN$: C, 73.20; H, 5.26; N, 6.09. Found: C, 73.38; H, 5.20; N, 6.25.

B. o-Chloro-N-(α-methyl benzylidene) aniline (XXI) (15 g) prepared by the procedure described in example XXVIIIA was hydrogenated using 5% Pd/C as the catalyst and 95% ethanol as the solvent. o-Chloro-N-(α-methyl benzyl) aniline (XXII) was obtained by fractional distillation. XXII had a boiling point of 134° C. at 1.2 millimeter.

Analysis calculated for $C_{14}H_{14}ClN$: C, 72.56; H, 6.08; N, 6.04. Found: C, 73.38; H, 6.05; N, 6.23.

EXAMPLE XXIX

A. A solution of p-diacetylbenzene (50 g), aniline (80 g) and benzene (120 ml) was refluxed in the presence of molecular sieve (10 g) with continuous removal of water. The crude product was crystallized from ethanol to give p-acetyl-N-(α-methyl benzylidene) aniline (XXIII). XXIII had a melting point of 205° C.

B. p-Acetyl-N-(α-methylbenzylidene) aniline (XXIII) (30 g) prepared by the procedure described in Example XXIXA was hydrogenated using 5% Pd/C as the catalyst and 95% ethanol as the solvent. p-Acetyl-N-(α-methyl benzyl) aniline (XXIV) was obtained by fractional distillation. XXIV had a boiling point of 165° C. at 0.1 millimeter.

Analysis calculated for $C_{16}H_{17}NO$: C, 80.30; H, 7.16; N, 5.85. Found: C, 80.00; H, 7.46; N, 5.50.

EXAMPLE XXX

A mixture of p-acetyl-N-(α-methyl benzylidene) aniline (XXIII) (40 g) prepared by the procedure described in example XXIXA and aniline (20 ml) was hydrogenated using 5% Pd/C as the catalyst and 95% ethanol as the solvent. The crude product was crystallized from ethanol to give 1,4-Bis-(1-anilinoethyl) benzene (XXV). XXV had a melting point of 169°–170° C.

EXAMPLE XXXI

A. A solution of α-tetralone (50 ml), dodecyl aniline (80 g) and benzene (150 ml) was refluxed in the presence of molecular sieve (100 g) with continuous removal of water. The crude product was crystallized from ethanol to give N-(1,2,3,4-tetrahydronaphthylidene) aniline (XXVI). XXVI had a melting point of 53° C.

Analysis calculated for $C_{28}H_{39}N$: C, 86.31; H, 10.09; N, 3.59. Found: C, 87.91; H, 10.05; N, 3.76.

B. N-(1,2,3,4-tetrahydronaphthylidene) aniline (XXVI) (38 g) prepared as described in example XXXIA was hydrogenated using 5% Pd/C as the catalyst and 95% ethanol as the solvent. The crude product was crystallized from ethanol to give 1-(p-dodecylanilino)-1,2,3,4-tetrahydronaphthalene (XXVII). XXVII had a melting point of 34° C.

Analysis calculated for $C_{28}H_{41}N$: C, 85.87; H, 10.55; N, 3.57. Found: C, 86.40; H, 10.69; N, 3.78.

EXAMPLE XXXII

A. A solution of α-tetralone (40 ml), ethyl-p-aminobenzoate (42 g) and benzene (100 ml) was refluxed in the presence of molecular sieve (100 g) with the continuous removal of water. The crude product was crystallized from ethanol to give N-(1,2,3,4-tetrahydonaphthylidene)-p-carbethoxyaniline (XXVIII). XXVIII had a.m.p. of 108.5° C.

Analysis calculated for $C_{19}H_{19}NO_2$: C, 77.78; H, 6.58; N, 4.77. Found: C, 77.95; H, 6.42; N, 4.85.

B. N-(1,2,3,4-Tetrahydronaphthylidene)-p-carbethoxyaniline (XXVIII) (30 g) prepared by the procedure described in example XXXIIA was hydrogenated using 5% Pd/C as the catalyst and 95% ethanol to give 1-(p-carbethoxy-anilino)-1,2,3,4-tetrahydronaphthalene (XXIX). XXIX had a melting point of 34° C.

Analysis calculated for $C_{19}H_{21}NO_2$: C, 77.26; H, 7.17; N, 4.74. Found: C, 77.84; H, 7.27; N, 4.92.

What is claimed is:

1. A compound having the formula:

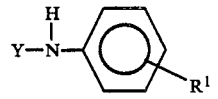

(I)

wherein Y is

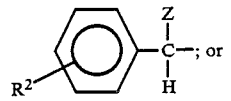

(II)

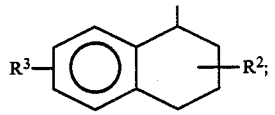

(III)

wherein:

when Y is a moiety of formula (II), Z is $C_1$–$C_3$ alkyl; $R^1$ is hydrogen, $C_1$–$C_{12}$ alkyl, $C_1$–$C_{12}$ alkoxy, $C_2$–$C_{18}$ carbalkoxy, halogen, or nitro; and $R^2$ is hydrogen, $C_1$–$C_{12}$ alkyl, $C_1$–$C_{12}$ alkoxy, $C_2$–$C_{18}$ carbalkoxy, halogen or nitro; and when Y is a moiety of formula (III), $R_1$ and $R_3$ are each independently hydrogen, $C_1$–$C_{12}$ alkyl, $C_1$–$C_{12}$ alkoxy, $C_2$–$C_{18}$ carbalkoxy, halogen, or nitro; and $R^2$ is as defined above.

2. A compound in accordance with claim 1 wherein Y is a moiety of formula (III).

3. A compound in accordance with claim 2 wherein $R^2$ and $R^3$ are hydrogen; and $R^1$ is p-$C_{12}H_{25}$ or p-$COOC_2H_5$.

4. A lubricating composition comprising:

(A) an antioxidant having the formula:

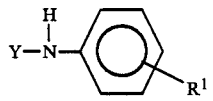

(I)

wherein Y is

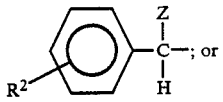

(II)

-continued (III)

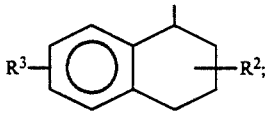

wherein:

when Y is a moiety of formula (II), Z is $C_1$–$C_3$ alkyl; $R^1$ is hydrogen, $C_1$–$C_{12}$ alkyl, $C_1$–$C_{12}$ alkoxy, $C_2$–$C_{18}$ carbalkoxy, halogen, or nitro; and $R^2$ is hydrogen, $C_1$–$C_{12}$ alkyl, $C_1$–$C_{12}$ alkoxy, $C_2$–$C_{18}$ carbalkoxy, halogen or nitro; and when Y is a moiety of formula (III), $R_1$ and $R_3$ are each independently hydrogen, $C_1$–$C_{12}$ alkyl, $C_1$–$C_{12}$ alkoxy, $C_2$–$C_{18}$ carbalkoxy, halogen, or nitro; and $R^2$ is as defined above; and (B) a lubricating oil.

5. A composition in accordance with claim 4 wherein component (B) is a lubricating oil selected from the group consisting of polyester oils, mineral oils and synthetic hydrocarbon oils.

6. A composition in accordance with claim 4 wherein Y is a moiety of formula (III).

7. A composition in accordance with claim 6 wherein $R^2$ and $R^3$ are hydrogen; and $R^1$ is p-$C_{12}H_{25}$ or p-$COOC_2H_5$.

8. A compound having the formula:

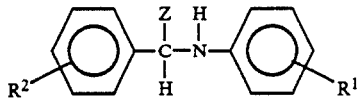

wherein Z is $C_1$–$C_3$ alkyl; $R^1$ is hydrogen, $C_1$–$C_{12}$ alkyl, $C_1$–$C_{12}$ alkoxy, $C_2$–$C_{18}$ carbalkoxy, halogen, or nitro; and $R^2$ is hydrogen, $C_1$–$C_{12}$ alkyl, $C_1$–$C_{12}$ alkoxy, $C_2$–$C_{18}$ carbalkoxy, halogen or nitro.

9. A compound in accordance with claim 8 wherein Z is methyl or ethyl; $R^1$ is hydrogen; and $R^2$ is hydrogen.

10. A compound in accordance with claim 8 wherein Z is $C_1$–$C_3$ alkyl; $R^1$ is hydrogen, chlorine, methoxy, ethoxy, $C_1$–$C_{12}$ alkyl, acetyl or 1-anilinoethyl; and $R^2$ is hydrogen or $C_1$–$C_9$ alkyl.

11. A lubricating composition comprising:

(A) an antioxidant having the formula:

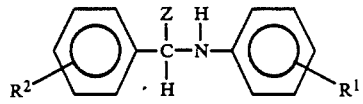

wherein Z is $C_1$–$C_3$ alkyl; $R^1$ is hydrogen, $C_1$–$C_{12}$ alkyl, $C_1$–$C_{12}$ alkoxy, $C_2$–$C_{18}$ carbalkoxy, halogen, or nitro; and $R^2$ is hydrogen, $C_1$–$C_{12}$ alkyl, $C_1$–$C_{12}$ alkoxy, $C_2$–$C_{18}$ carbalkoxy, halogen or nitro; and (B) a lubricating oil.

12. A composition in accordance with claim 11 wherein Z is methyl or ethyl; $R^1$ is hydrogen; and $R^2$ is hydrogen.

13. A composition in accordance with claim 11 wherein Z is $C_1$–$C_3$ alkyl; $R^1$ is hydrogen, chlorine, methoxy, ethoxy, $C_1$–$C_{12}$ alkyl, acetyl or 1-anilinoethyl; and $R^2$ is hydrogen or $C_1$–$C_9$ alkyl.

* * * * *